US005977910A

United States Patent [19]

Matthews

[11] Patent Number: 5,977,910

[45] Date of Patent: Nov. 2, 1999

[54] MULTIBEAM PHASED ARRAY ANTENNA SYSTEM

[75] Inventor: Edgar W. Matthews, Mountain View, Calif.

[73] Assignee: Space Systems/Loral, Inc., Palo Alto, Calif.

[21] Appl. No.: 08/908,484

[22] Filed: Aug. 7, 1997

[51] Int. Cl.[6] ..... H01Q 3/26

[52] U.S. Cl. ..... 342/368; 342/372

[58] Field of Search ..... 342/368, 371, 342/372

[56] References Cited

U.S. PATENT DOCUMENTS

| | | | |
|---|---|---|---|
| 4,652,879 | 3/1987 | Rudish | 342/371 |
| 4,973,971 | 11/1990 | Sinsky | 342/373 |
| 5,642,358 | 6/1997 | Dent | 370/323 |

*Primary Examiner*—Thomas H. Tarcza
*Assistant Examiner*—Devin Drummond
*Attorney, Agent, or Firm*—Perman & Green, LLP

[57] ABSTRACT

A method and an apparatus for a multibeam phased array antenna transmission based on heterodyning to produce the RF transmission signals with appropriate phase shift and thereby reducing the effect of certain space constraints in the confined area of the transmitter as higher and higher frequencies of transmission are employed. In the present invention, RF signals at an intermediate frequency, not the ultimate frequency of transmission, comprise the signal frequencies of a beam forming network which provides input to a multiplexed power divider. The power divider outputs the phase shifted signals to an input at each of a number of multiplexed combiners. The output of each combiner is fed to a mixing device which then shifts the input frequency to a higher frequency, using an appropriate local oscillator signal. The mixer outputs are coupled to separate power amplifiers, whose outputs are fed to the elemental radiators. The use of a lower primary frequency in the power divider and the combiner stages permits the use of conventionally sized components, rather than miniature elements normally associated with millimeter-wave circuitry.

10 Claims, 4 Drawing Sheets

MULTIBEAM PHASED ARRAY ANTENNA SYSTEM

FIELD OF THE INVENTION

The present invention relates to phased array antenna systems, and more particularly to a phased array antenna system for applications requiring very high frequency transmission and reception.

BACKGROUND OF THE INVENTION

Phased array antennas exhibit desirable properties for communications and radar systems, the most salient of which is the lack of any requirement for mechanically steering the transmission beam. This feature allows for very rapid beam scanning and the ability to bring high power to a target or a receiver while minimizing typical microwave power losses. The basis for directivity control in a phased array antenna systems is wave interference. By providing a large number of sources of radiation, such as a large number of equally spaced antenna elements fed from a combination of in phase currents, high directivity can be achieved. With multiple antenna elements configured as an array, it is therefore possible, with a fixed amount of power, to greatly reinforce radiation in a desired direction.

FIG. 1 depicts a conventional multi phased array antenna system having multiple microwave radiating horns 33 connected to a respective transmission system. The antenna radiator 33 transmits a pattern which has a mainbeam and a series of lobes focused at differing solid angles which contribute to transmitting radio frequencies in a given direction. The term RF employed herein is considered particularly with respect to the "millimeter-wave" region of the RF spectrum (frequencies above 20 GHz). By modifying the phase angle of the RF signal representing the electric field, a phased array antenna system can both transmit and receive electromagnetic radiation from different angles. Typical phased array systems transmit and receive at frequencies selected from a frequency band in the range of between 300 Megahertz to 40 Gigahertz.

New applications for phased array antenna systems constantly push the design envelope for increasingly higher transmission frequencies, however, increasing the frequency requires that the radiating elements and the components associated with the radiating elements be placed in increasingly closer and closer proximity to one another. It is found that as the frequency of transmission increases, the use of multibeam arrayed configurations of antenna system elements becomes limited by the physical space required to incorporate the system elements.

Multibeam phased arrays are typically comprised of a multiplicity of individual beam forming transmission elements. The phased arrays are processed by combining the voltages from a plurality of beam forming signals that are individually phased, amplified, filtered and impressed on antenna elements, such as the radiator horns 33 of the prior art system of FIG. 1, to produce multiple beams in different directions. As shown, an RF beam 10-1, having a primary frequency $f_1$ is connected to a transmitting power divider 20-1, whose multiple outputs 24-1 through 24-n are connected to separate phase shift means 25. The outputs of the phase shift means 25 for different beams are combined in a combiner means 22, whose function is to combine properly phased signals for each beam which are assigned to particular radiating elements.

A second RF beam 10-2 of another frequency $f_2$ is connected through similar circuit elements as RF beam 10-1 as shown in the prior art system of FIG. 1. Thus, typically the radio frequency beam phase and amplitude ultimately to be transmitted by the antenna are first delivered to the beam forming network that consists of a plurality of multiplexed power dividers such as divider 20 which provides a plurality of signals and couples a signal having a particular phase to one input of a multiplicity of inputs of a plurality of combiners such as combiner 22. Essentially each combiner receives signals at each transmission frequency, with appropriate phase angles from each of the plurality of power dividers, and combines these inputs to form a composite signal for the transmitted RF energy. In the prior art as shown in FIG. 1, the combined RF signals are coupled to the transmitting elements through power amplifiers 26, filters 30 and finally the radiator horns 33.

The use of phased array antenna systems that have a high degree of fidelity across all the radiators 33 is crucial to the success of most applications to which phased array systems are employed. This is accomplished through use advanced technologies in antenna design and processing circuitry. For example, phased array antennas constructed from MMIC chip technology at each antenna subsystem element(forming the so-called active array antenna) allow for very large effective-radiated-power levels and large system redundancy. As newer technologies emerge it becomes feasible to extend the transmission frequencies into the tens of gigahertz. However, existing fabrication and electronic designs do not permit the close proximity of elements required at such newer higher frequencies. For example, an 8-beam phased array having 100 elements in the array would require eight 100-way power dividers, 800 phase shifters, and 100 eight-way combiners, plus 100 power amplifiers, filters and radiating elements. So large a number of components in the aggregate cannot feasibly be accommodated in the small space required in and about the antenna section of the conventional system, especially with the myriad of waveguides required for the many interconnections.

Phased array antennas are extremely expensive to produce, in part, because of the large number of interconnections for the signal distribution and phase control. The problems of system cost are compounded in multibeam phased array applications. As transmission frequencies for multibeam phased array systems are pushed to new limits, new and novel electronic design techniques must follow. The present invention provides a system that allows increases in the frequency of transmission of a multibeam RF transmission antenna system without being limited by physical space requirements.

SUMMARY OF THE INVENTION

An object of the present invention is to provide a method and an apparatus for a multibeam phased array antenna transmission employing heterodyning to produce the required transmission signals with appropriate phase shift, thereby reducing the effect of certain space constraints in the confined area of the transmitter, as higher and higher frequencies of transmission are employed.

Another object of the present invention is to increase the transmission frequency of a phased array antenna system by utilizing an intermediate frequency in some stages of the antenna subsystem and therefore alleviate the space constraints otherwise imposed by the higher frequency.

In the present invention, RF signals at an intermediate frequency, not the ultimate frequency of transmission, comprise the signal frequency for a beam forming network which provides input to a multiplexed power divider. The use of a lower frequency in the power divider, phaser and combiner stages thereby permits the use of conventionally sized components.

The power divider outputs a signal having a desired phase to an input at each of a number of multiplexed combiners, the outputs of which are fed to mixing devices which then shift the input frequency to a higher frequency for transmission. To those skilled in the art, this technique is known as heterodyning where the lower frequency is mixed with a higher frequency in a non-linear device to produce frequencies both higher and lower than the original frequencies. In RF applications heterodyning is accomplished through a non-linear device referred to as a mixer which produces side band frequencies, one of which is at the desired frequency of transmission. Each mixer thus requires a local oscillator signal, which is at a frequency which is the difference between the input frequency and the desired output frequency.

The present invention therefore is a method and apparatus for a phased array antenna system having adjustable phase and amplitude feeding coefficients. The invention first provides for a plurality of RF beams at a primary, intermediate frequency, as input to a plurality of power dividers, the outputs of which are coupled to a plurality of associated phase shifters whose outputs are coupled to a plurality of associated combiners. The outputs of the combiners which are at the primary frequency then are mixed or heterodyned with a higher reference frequency to produce a desired set of signals at the transmitting frequency. The use of the mixer allows a lower frequency to be used in the stages leading up to the power amplifier and until that stage permits the use of components, the physical size of which are not constrained by the physical space required for their implementation at the transmit frequency.

BRIEF DESCRIPTION OF THE DRAWINGS

The novel features of the present invention are set forth with particularity in the appended claims. The invention itself, however, both as to its organization and method of operation, together with further objects and advantages thereof, may be best understood by reference to the following description taken in conjunction with the accompanying drawings, in which:

DESCRIPTION OF THE PREFERRED EMBODIMENTS

The present invention is an apparatus for a phased array antenna system providing multiple beams which are independently steerable for transmission or reception, having adjustable phase and amplitude feeding coefficients comprising: a means for generating a reference frequency; a means for generating a plurality of primary frequency RF beam signals; dividing each of the beams and coupling the divided beams to a phase shifter after which the shifted beam signals are combined and mixed with a local oscillator at the reference frequency to produce a desired transmitting frequency.

Figure 1:
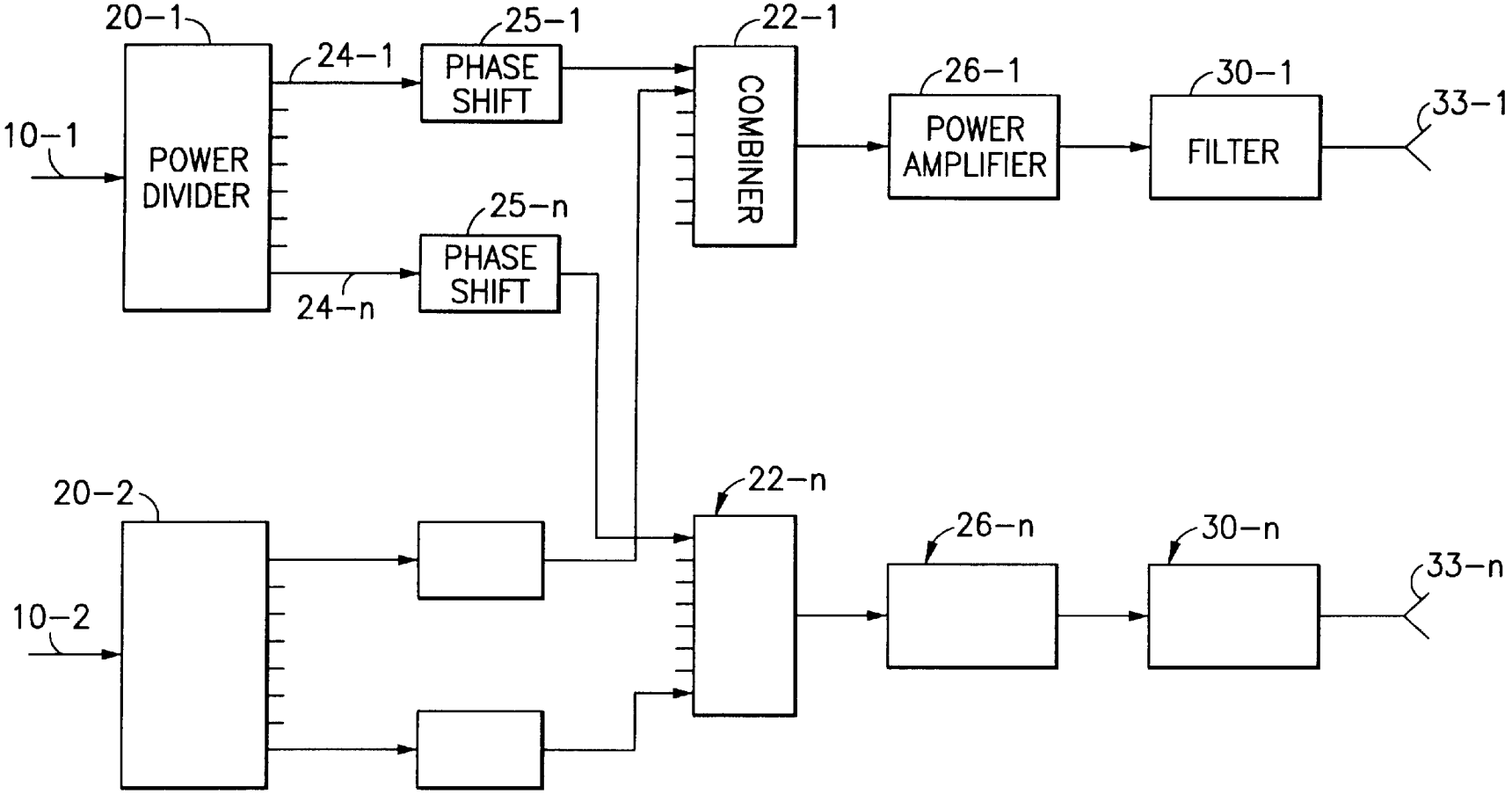
FIG. 1 PRIOR ART
FIG. 1 is a schematic block diagram of an embodiment of a prior art conventional phased array antenna system.
Figure 2:
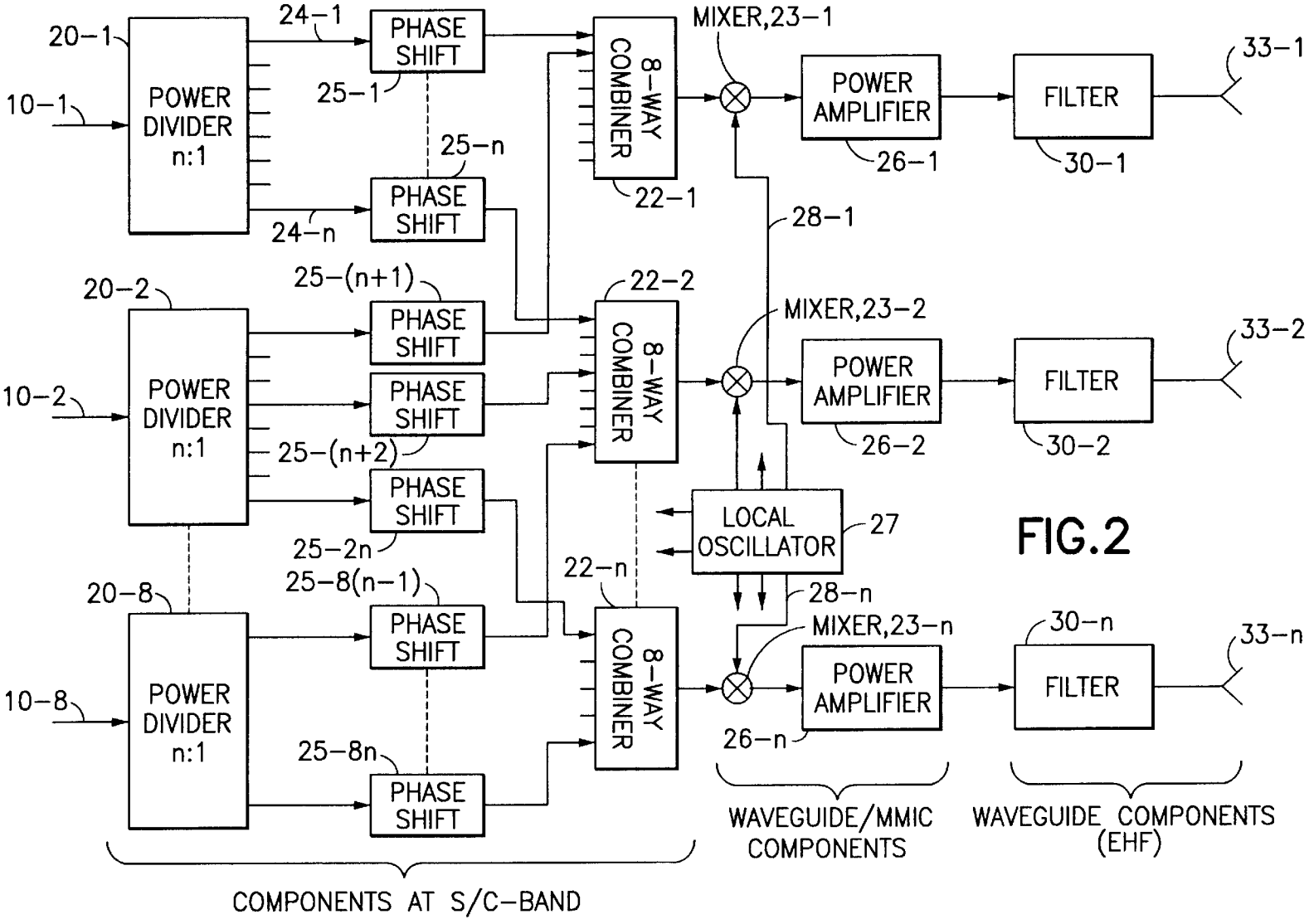
FIG. 2 is a schematic block diagram of an embodiment of the present invention phased array antenna system showing the power dividers, combiners and heterodyning elements.

In FIG. 2, blocks and associated arrows represent functions of the process according to the present invention which may be implemented as electrical circuits typically utilizing MMIC, waveguide, stripline technology and associated wires or data busses, which transport electrical signals.

Referring to FIG. 2, an embodiment is shown of an n-element phased array system consisting of a beam forming network ("BFN") wherein "m" RF beams are inputted to a set of power dividers 20-1 through 20-m, phaser shift means 25-1 through 25-n, combiners 22-1 through 22-n, a local oscillator 27, power amplifiers 26-1 through 26-n, filters 30-1 through 30-n and radiators 33-1 through 33-n. By way of illustration, beam 10-1 and beam 10-2 represent two of a multibeam set of electronically formed signals at an intermediate primary frequency. In the preferred embodiment, eight such beams (i.e. m=8) are fed into power dividers 20-1 through 20-8. Each of the power dividers, such as the power divider 20-1, supplies an output signal having an amplitude and phase to a phase shift means 25-1 which shifts the phase a predetermined amount. Generally, there are as many phase shift means n on each power divider 20-1 through 20-n output as there are array elements 1 through n. In the case of the preferred embodiment there are n phase shift means 25-1 through 25-n for the power divider 20-1, and the embodiment of FIG. 2 will include a total of 8n phase shift means.

Combiner means 22-1 through combiner means 22-n each include eight combiner circuits for a total of **8*n*, and each fed one phase shifted signal from one of the outputs of phase shift means 25-1 through 25-8*n*. The combiner means 22-1 through 22-n are coupled to mixers 23-1 through 23-n, which are supplied from a common local oscillator 27; these produce the beam signal at the higher frequency with proper phases to be transmitted for each beam. The typical frequency of the primary frequency is in the S-band or C-band whereas the transmitted frequency is upwards of 20 GHz. Typically a 6 GHz primary frequency signal mixed with a 14 GHz reference signal will produce a 20 GHz transmission signal. The local oscillator 27 outputs 28-1 through 28-n are mixed with the signals from the combiner means 22-1 through 22-n, respectively and the resulting signals are then fed to power amplifiers 26-1 through 26-n. The power amplifiers 26-1 through 26-n are then fed to corresponding filters 30-1 through 30-n which feed transmission antenna radiation horns 33-1 through 33**-n.

Figure 3:
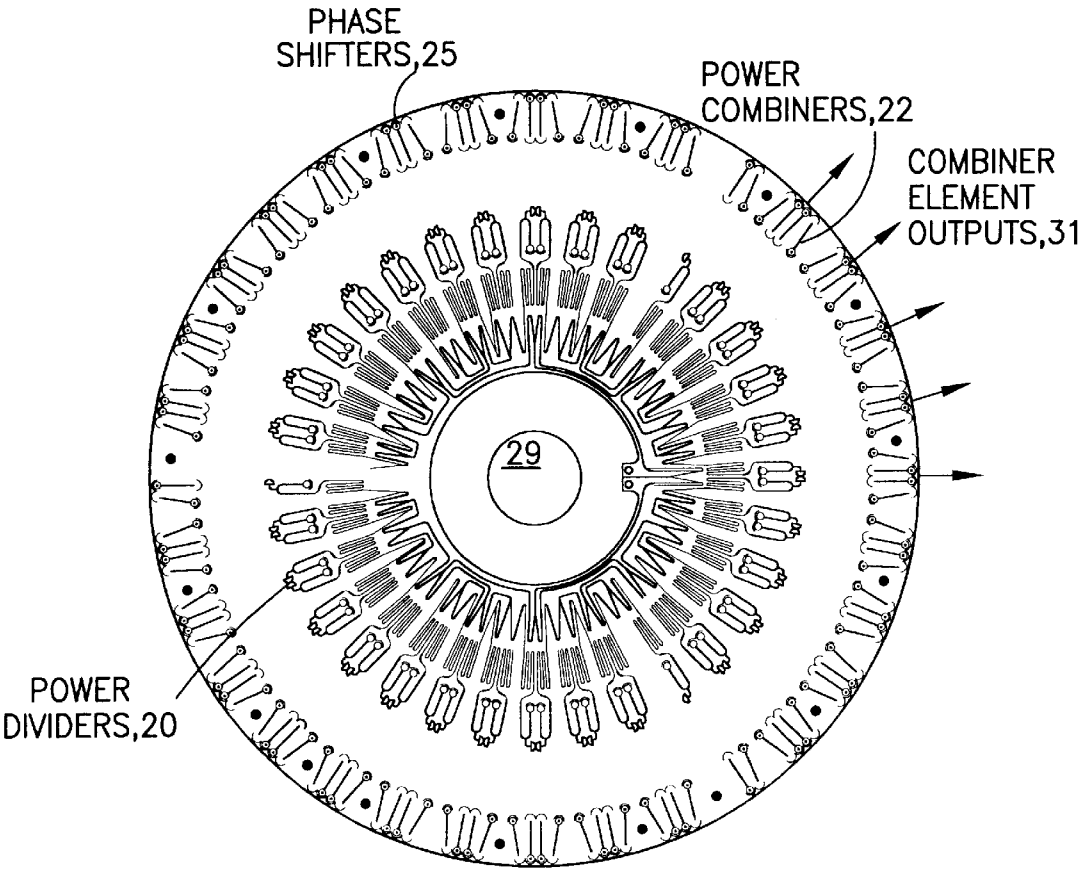
FIG. 3 is a plan view of an illustration of a typical beam forming network.

FIG. 3 shows a typical stripline beam forming network, such as would form beam 1, of the type that may be employed in the present invention. Input port 29 receives the primary signal such as beam 1 of FIG. 2 which is divided through power divider 20 and phase shifted through phase shift means 25. The phase shift means in the preferred embodiment are based on MMIC technology. The phase shift means 25 output is coupled to power combiner means 22 and presented at the combined element outputs 31.

Figure 4:
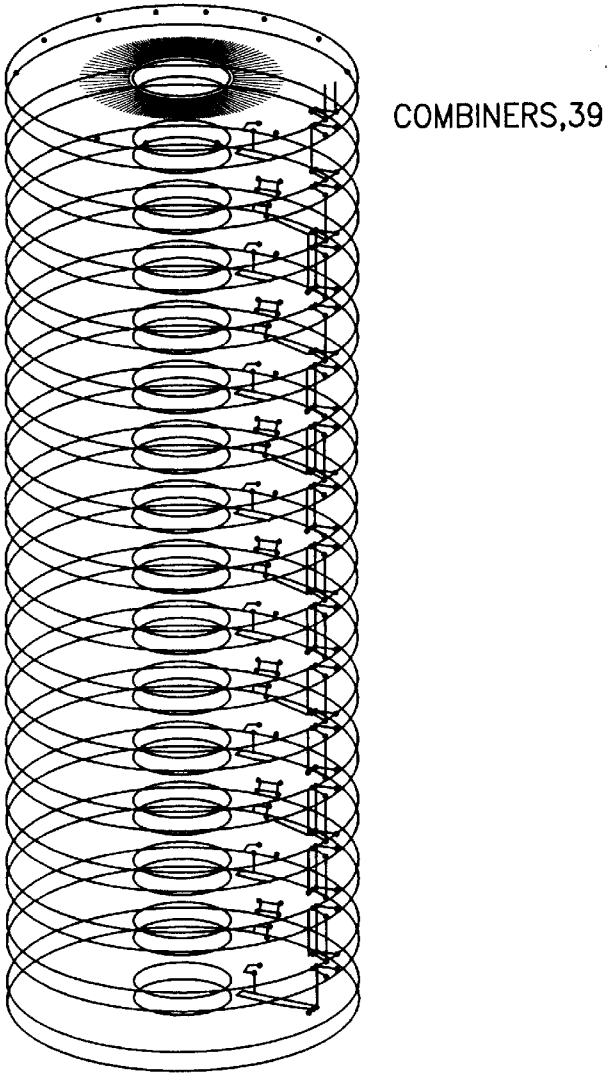
FIG. 4 is an illustration of an 8-way power combiner of the type utilized in the present invention.
Figure 5:
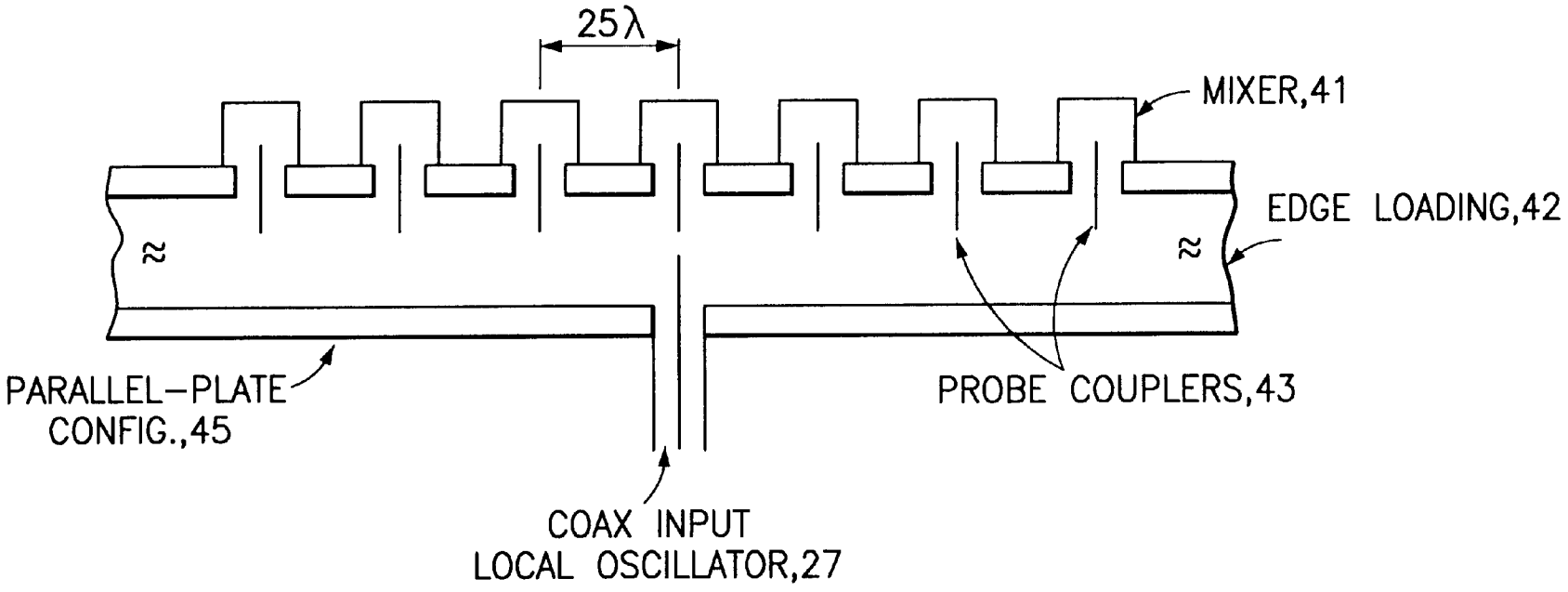
FIG. 5 is a schematic illustration of an embodiment of a local oscillator distribution network.

FIG. 4 illustrates an embodiment of a multiple beam forming network implemented as a stripline stack of individual beam forming networks 39. The output elements are coupled to a separate layer individual mixers and to the local oscillator 27. FIG. 5 illustrates an embodiment of a local oscillator distribution network. The oscillator 27 in FIG. 5 may be implemented in MMIC technology. The heterodyning circuit is comprised of a parallel plate local oscillator distribution circuit 45, edge loading 42, and a series of mixers 41. The local oscillator reference signal is provided by way of a coaxial cable connected to input port 44. The probe coupler 43 couples the higher frequency output of the local oscillator 27 to the individual mixers 41, whose heterodyned outputs are fed by waveguide, with appropriate filtering, to the power amplifiers 26.

The present invention also provides a method for a phased array antenna system having adjustable phase and amplitude feeding coefficients comprising the steps of generating a reference frequency, coupling a plurality of primary frequency RF beams to a plurality of corresponding power dividers, coupling each power divided beam to a plurality of corresponding phase shifters whose output are coupled to a plurality of associated means to combine signals from associated phase shifted beams and heterodyning the combined output beams at the primary frequency and the lower reference frequency to produce a desired transmitting frequency.

A feature of the invention is that it permits the use of conventional lower-frequency stripline or printed-circuit components for the network portion of the array, plus MMIC phasers, followed by individual mixers for each element to heterodyne the primary frequency signals to the desired output frequencies, followed by individual millimeter-wave power amplifiers, filters and radiating elements. The invention affords the advantage of using conventional lower-frequency beam-forming circuitry, which is easier to build, less costly, and avoids the size restrictions of higher-frequency circuits. Interconnections to the closely-spaced millimeter-wave components can be by means of low-loss coaxial cables, thus allowing more space for the conventional circuitry.

While preferred embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention. In particular, although the description of the invention is couched in terms of a transmit array, the concept applies equally well to a receive array.

What is claimed is:

1. An apparatus for a multiple-beam millimeter-wave phased array transmitter system comprising signal forming circuit network means responsive to a plurality of input beam signals having a primary lower RF frequency for dividing, phase shifting and combining said signals into a plurality of output signals at said lower frequency;

a local oscillator means for providing an output signal having a frequency higher than the primary frequency;

a heterodyning means connected to each of said circuit network output signals at said lower frequency and to said output signal of said local oscillator means at said higher frequency for providing a plurality of output signals at a desired output frequency higher than said primary frequency.

2. An apparatus according to claim 1 further including a power amplifier connected to the output of each of said heterodyning means to amplify said higher frequency signal;

a filter means connected to each of said amplifier means for rejecting unwanted output frequencies;

and a signal radiating means for transmitting said higher frequency signals in a multiple-beam phase array.

3. An apparatus according to claim 1 wherein said primary frequency is within the S-band or C-band and said higher frequency output signals have frequencies equal to or greater than 20 GHz.

4. An apparatus according to claim 1 wherein said primary frequency is 6 Ghz and said higher output signal frequency is 20 GHz.

5. An apparatus according to claim 1 wherein said signal forming network is comprised of a stripline signal forming network.

6. An apparatus according to claim 5 wherein said stripline signal forming network includes a stack of separate stripline elements in combination.

7. An apparatus for a multiple-beam millimeter-wave phase array antenna transmitter system comprising:

a plurality of power divider circuit means, each connected to a separate one of a plurality of primary frequency RF input beam signals for dividing each of said input beam signals into a plurality of divided output signals, at said primary frequency, a plurality of MMIC phase shift circuit means each connected to a separate one of said plurality of divided output signals of said power divider circuit means to provide phase shifted output signals at said primary frequency, a plurality of combiner circuit means connected to said plurality of MMIC phase shift circuit means for combining together selected ones of said shifted output signals form said phase shift circuit means, a local oscillator means for providing an output signal having a frequency higher than the primary frequency, a plurality of mixer circuit means connected to said combiner circuit means and to said output signal of said local oscillator means for heterodyning said primary frequency signals from said combiner means with said local oscillator frequency signal higher than the primary frequency to convert the primary frequency output signals from said combiner circuit to desired output frequencies higher than said primary frequency.

8. An apparatus according to claim 7 further including a millimeter-wave power amplifier circuit means connected to the output of each of said mixer circuit means, a filter means connector to the output of each of said power amplifier means, and a signal radiating means connected to each said filter means for transmitting millimeter-wave phased array output beam signals at said higher frequency.

9. A method for transmitting a multiple-beam millimeter-wave phased array output signals comprising the steps of:

dividing each of a plurality of primary frequency RF input beam signals into plurality of divided primary frequency signals, shifting the phase of said divided signals, combining selected ones of said phase shifted divided primary frequency signals together, to provide a plurality of combined phase shifted primary frequency signals, heterodyning all of said combined primary frequency phase shifted signals with a local oscillator frequency signal higher than the primary frequency, to convert the primary frequency of said combined signals to desired higher frequency output frequency signals.

10. A method according to claim 9 further including the step of transmitting said higher frequency output signals via a multiple-beam phased array antenna means.

* * * * *